United States Patent [19]

Stein

[11] Patent Number: 5,041,042

[45] Date of Patent: Aug. 20, 1991

[54] FLYING BUBBLE TOY

[76] Inventor: David Stein, 817 West End Avenue, New York, N.Y. 10025

[21] Appl. No.: 452,815

[22] Filed: Dec. 19, 1989

[51] Int. Cl.[5] ..... A63H 33/28; A63H 27/00; A63B 65/10

[52] U.S. Cl. ..... 446/15; 446/48; 273/424; 273/425

[58] Field of Search ..... 446/15, 16, 17, 18, 446/21, 30, 31, 34, 36, 46, 47, 48, 61, 67; 273/424, 425, 427, 428; 244/12.2

[56] References Cited

U.S. PATENT DOCUMENTS

| | | | |
|---|---|---|---|
| 862,094 | 7/1907 | Morton | 446/36 |
| 2,398,513 | 4/1946 | Bradley | 446/15 |
| 2,556,756 | 6/1951 | Gray | 446/15 |
| 2,606,395 | 8/1952 | Fulton | 446/15 |
| 2,942,375 | 6/1960 | Bucic, Jr. | 446/15 |
| 3,002,314 | 10/1961 | Brottman | 446/15 |
| 3,008,263 | 11/1961 | Ellman | 446/15 |
| 3,036,832 | 5/1962 | Ellman et al. | 446/43 |
| 3,295,248 | 1/1967 | Knerr et al. | 446/15 |
| 3,594,945 | 7/1971 | Turney | 446/48 |
| 3,600,842 | 8/1971 | Bryman | 446/15 |
| 3,736,694 | 6/1973 | Lebensfeld | 446/16 |
| 3,745,693 | 7/1973 | La Fata et al. | 446/15 |
| 3,765,122 | 10/1973 | English | 446/48 |
| 3,881,729 | 5/1975 | Block et al. | 446/36 X |
| 3,955,817 | 5/1976 | Davis | 446/46 X |
| 3,976,297 | 8/1976 | Seymour | 446/30 X |
| 4,115,946 | 9/1978 | Vukmirovich | 446/46 X |
| 4,157,632 | 6/1979 | Everett | 446/46 X |
| 4,173,839 | 11/1979 | Kovac | 446/46 |
| 4,184,284 | 1/1980 | Rogahn | 446/15 |
| 4,238,906 | 12/1980 | Bradford, Sr. | 446/36 |
| 4,506,894 | 3/1985 | Laux et al. | 273/425 |
| 4,560,358 | 12/1985 | Adler | 446/46 |
| 4,591,164 | 5/1986 | Blight | 273/425 |
| 4,802,875 | 2/1989 | Cunningham | 446/46 |

FOREIGN PATENT DOCUMENTS

| | | | |
|---|---|---|---|
| 2468389 | 5/1981 | France | 273/424 |

OTHER PUBLICATIONS

"Million Bubbles"-Instruction Sheet.

*Primary Examiner*—Mickey Yu
*Assistant Examiner*—D. Neal Muir
*Attorney, Agent, or Firm*—Gottlieb, Rackman & Reisman

[57] ABSTRACT

A flying bubble toy comprising a substantially open framework lying in a plane is provided. The framework has an axis of rotation during flight perpendicular to the plane, and includes one or more bubble forming apertures lying therein which are suitable for holding and releasing solution in the form of bubbles.

37 Claims, 2 Drawing Sheets

FLYING BUBBLE TOY

This invention relates to a flying bubble toy able to produce a stream of bubbles during free flight, and a method for using said toy. A preferred embodiment of the toy comprises a planar open framework including one or more apertures able to hold and release bubble solution as a stream of bubbles. The preferred method of use comprises dipping the planar open framework including the bubble-forming apertures in bubble solution, and then launching said framework edgewise through the air. Owing to the edgewise launch, air initially moves mostly past rather than through said apertures, so that most of the solution stored in the apertures is retained during the first part of flight. In midflight, the changing trajectory of the toy begins to move air through the framework and apertures, creating an increasing stream of bubbles which form a beautiful arc in the final falling portion of the flight.

Definitions

For purposes of this document, the term "open framework" refers to any construction in which the bubble-forming apertures included therein are bordered substantially by other apertures, or by larger open spaces. A given construction or portion thereof is considered "skeletal" if it is composed of extended rods or blades, which may be straight, curved, a sometimes shaped into rings or other closed figures.

A given framework or portion thereof is considered "substantially planar" if it can be placed within a spatial envelope shaped as a thin flat disk.

"Aerodynamic surface" refers to any surface able to provide substantial lift in an air stream.

Objects of the Invention

The objects of this invention are set forth as follows:

One object is to provide a toy able to produce bubbles during free flight.

Another object is to provide a toy able to produce bubbles continuously throughout the longest possible flight, or at least to produce bubbles towards the end of the longest possible flight. This requires that substantial amounts of solution be retained by the toy during launching and during the first part of the flight for release later in the trajectory.

A third object is to provide a toy which can be prepared for flight simply by dipping the toy in solution, and which requires no other accessories other than containers of solution.

A fourth object is to provide a toy which can be easily caught, and which lends itself to games of catch involving two or more people. The toy should be of a configuration which can be easily caught while wet with slippery soap.

A fifth object is to provide a toy which, except for solution-storing surfaces feeding the bubble-producing apertures, minimizes extraneous solution-bearing surfaces, so that a person attempting to catch the toy is not splashed with extraneous solution, and so that waste of solution is minimized.

A sixth object is to provide a toy which is safe. The leading edges of the toy as it flies should be smooth, and not sharp or so hard as to present a danger to a catcher or passerby.

A seventh object is to provide a toy which in some embodiments may include an aerodynamic surface able to prolong the flight, or cause the toy to boomerang back to the operator.

An eighth object is to provide a toy which in some embodiments may include means for storing additional bubble solution on board, and means for feeding said solution to the bubble-forming apertures during flight.

A ninth object is to provide a toy which during flight produces mostly individual free-flying bubbles, rather than masses of foam.

A tenth object is to provide a toy having handle means or a method of dipping enabling one to dip the bubble-forming apertures in solution without wetting the fingers.

An eleventh object in some embodiments is to provide a toy which can be collapsed or folded for dipping into a relatively small container of solution.

A twelfth object in some embodiments is to provide a toy which at the player's option can be tethered and swung through the air in tethered flight, producing bubbles.

GENERAL DESCRIPTION OF THE INVENTION

The toy of this invention comprises the following elements:

A substantially open framework lying substantially in a plane; an axis of rotation during flight perpendicular to said plane; one or more bubble-forming apertures lying substantially in said plane able to hold and release solution in the form of bubbles.

The method for using the toy of this invention comprises the following steps:

(i) Dipping in bubble solution one or more bubble apertures included in a planar substantially open framework comprised in the toy.

(ii) launching said framework edgewise through the air, whereby during the first part of flight, air moves substantially across, i.e. above and below, rather than through the bubble apertures, so that most solution stored in said apertures is temporarily retained, and (iii) allowing the changing trajectory of the apparatus in midflight to begin passing air through the bubble apertures, thereby creating a stream of bubbles, increasingly towards the end of flight.

Prior Art

The advantages of the present invention will be clearly seen upon examination of the prior art relating to flying bubble toys.

U.S. Pat. No. 3,600,842 issued to Harold Bryman describes a toy consisting essentially of an open-ended cylindrical can, with a bubble-forming ring placed across one of the ends. When the cylinder is dipped in solution, and thrown forward through the air, bubbles are meant to stream from the rear. The disadvantage of this device is that all the bubbles will be released at the start of the flight.

U.S. Pat. No. 3,002,314 issued to I. Brottman, again is essentially a cylindrical can (in this case shaped like a rocket) with some bubble-forming apertures placed across one end. This toy has the same disadvantage-the bubbles tend to be released all at once due to the sudden acceleration of launching. In contrast, the present invention, when launched edgewise as previously described, retains substantial solution to release as bubbles later in the flight.

U.S. Pat. Nos. 3,745,693 issued to La Fata and Cuccio; 3,008,263 issued to J. Ellman; 2,942,375 issued to G. Bucic Jr.; and 2,398,513 issued to Bradley, all describe bubble toys designed to be whirled on a tether. All four incorporate a solution reservoir, means of feeding solution continuously to a bubble-forming aperture, and a tether. All are claimed to produce bubbles during tethered flight. However none is designed to be dipped in solution, launched into free flight, or caught by a second player like the present invention.

U.S. Pat. No. 4,184,284 issued to Dino J. Rogahn describes a bubble toy meant to be launched through the air and intended to produce bubbles in flight. Rogahn's patent abstract states: "A plate-like member, having a plurality of apertures therethrough, carries a reservoir having a removable closure member with a lifting rotor. The device is propelled into rotating flight. During flight, the rotor lifts the closure member from the reservoir, freeing the solution which is distributed by centrifugal force as a film on the upper surface of the plate and over the apertures. Bubbles are produced in response to air passing through the apertures and the film of bubble producing solution."

Instead of the "plate-like member" of Rogahn, the present invention comprises an open framework, and its advantages are several. First, the air flowing freely through the open framework of the present toy carries the bubbles away as individual free-flying spheres. In the Rogahn device, however, air is obstructed by the rotating plate, and there is a tendency for bubbles to adhere to the continuous surface of the plate, sliding against one another and dropping in clumps of foam. Second, the bubble apertures of the present toy, being charged with solution by dipping, can be much larger than the tiny holes in Rogahn's plate, their size being strictly limited by his method of centrifugal feeding of solution across the plate surface. Thus, in the present invention, the bubbles produced can be much larger, and much more visible and enjoyable at a distance, which is important in a toy designed to be thrown a considerable ways.

Preferred embodiments of the present toy are very easy to catch, merely by thrusting a finger or two forward into the large open spaces of the framework; this is a great advantage over Rogahn's plate, which when slippery with soap would be nearly impossible to catch on the fly.

The open framework of the present toy presents a minimum surface for the adherence of extraneous solution, whereas the plate of Rogahn will still be carrying substantially most of its load of soap at the end of the flight. An attempt to catch this soaploaded plate results in the receiving player being splashed with soap (a substantial hazard to the eyes), or most of the soap solution being dashed on the ground and wasted.

The present invention also has great advantages regarding ease of play as compared to Rogahn. During one-person play with the Rogahn plate and propeller, the following complex procedure is required between any two flights: retrieve the disk; retrieve the propeller; fit the propeller on the disk; pour solution from a bottle into the narrow opening on top; raise disk and propeller without spilling; wipe a portion of the slippery disk sufficiently free of soap to grip; and throw. In contrast, the present toy is simply dipped in a pan of solution and thrown. Unlike the Rogahn plate, it can be easily caught by a second player (eliminating need of retrieval), who dips it in a second pan of solution, and throws it back. Play is quick and continuous, without constant interruptions for retrieval, fitting parts together, filling reservoirs, etc.

Some embodiments of the present invention include an aerodynamic surface in the form of a ring, or radial blades, or a boomerang. Many patents exist for flying toys incorporating such aerodynamic shapes. The present invention contemplates use of aerodynamic elements such as those disclosed in Turney Patent No. 3,594,945; English Patent No. 3,765,122; Adler Patent No. 4,560,358; Ellman Patent No. 3,036,832; Davis Patent No. 3,955,817, and others of a similar nature. None of these patents is directed towards making bubbles.

Some embodiments of the present invention call for a flying bubble toy which may be folded so as to permit dipping in a smaller container of solution. U.S. Pat. No. 4,115,946 issued to Vakmirovich does describe a foldable flying disk. However, this device is not suitable for making bubbles, and does not have an open framework.

FIGURES OF THE DRAWINGS

DETAILED DESCRIPTION

Figure 1:
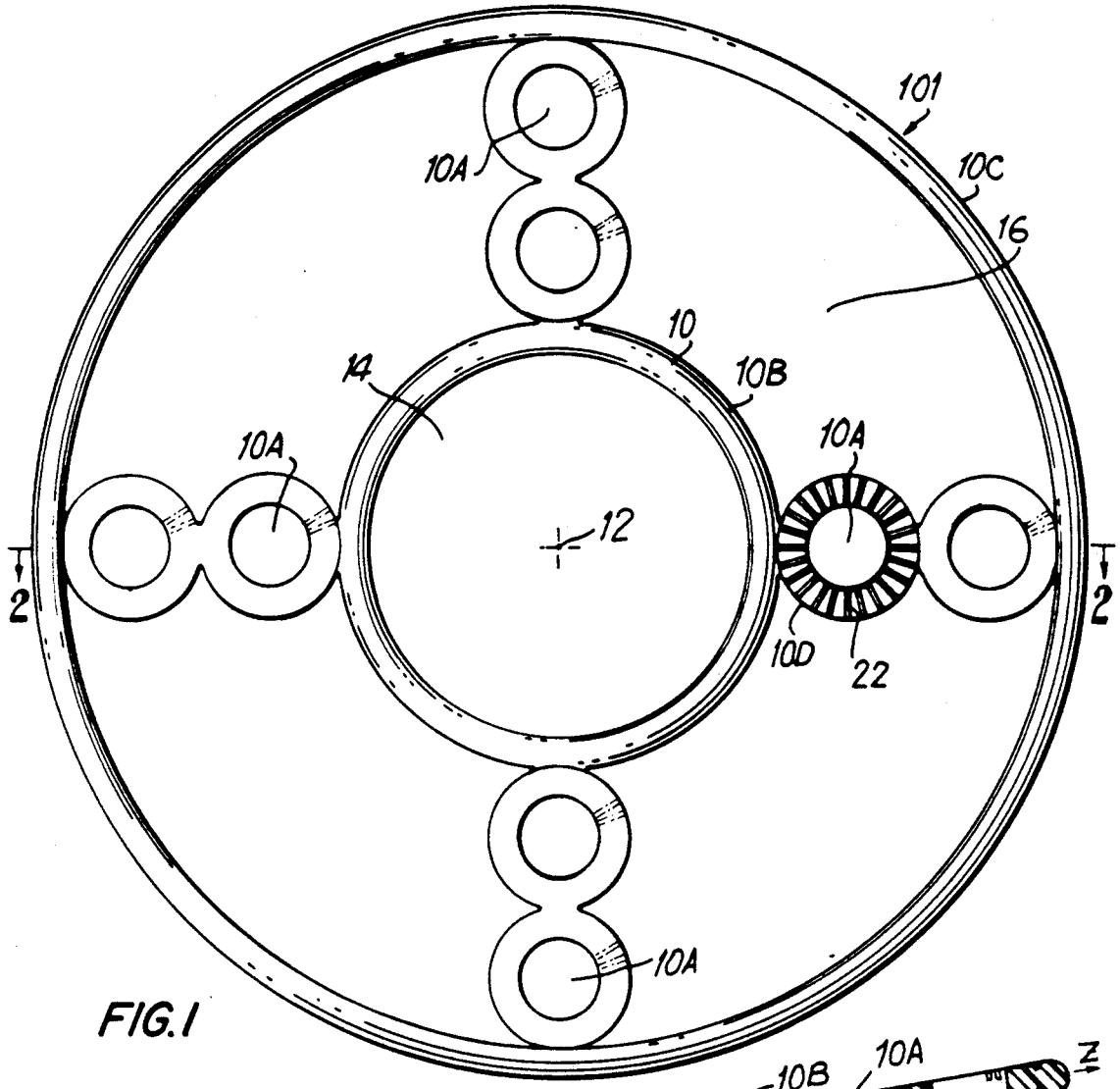
FIG. 1 shows a preferred embodiment of the toy comprising a skeletal open framework lying substantially in a plane and having an axis of rotation during flight perpendicular to said plane.
Figure 2:
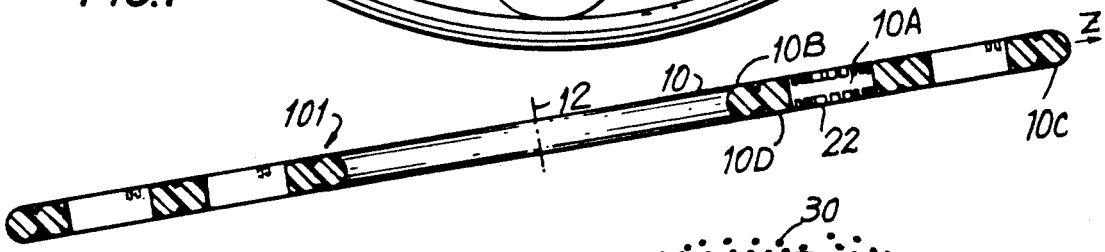
FIG. 2 is a section of the preferred embodiment, taken along the line 2—2 of FIG. 1.

The first form of the toy apparatus 101, seen in FIGS. 1 and 2, comprises a planar skeletal open framework 10. Said framework includes several bubble-forming apertures 10A, eight being shown in FIG. 1, inner circular frame element 10B and an outer circular frame element 10C forming the perimeter of the apparatus. Apertures 10A are each surrounded by a circular solution storage ring 10D, and lie substantially in a plane.

Apparatus 101 has an axis of rotation 12 during flight which is substantially perpendicular to planar framework 10. Framework 10 has large open spaces such as 14 and 16, so that apertures 10A are bordered substantially by open space.

A texture, such as the one of radial grooves and ridges shown at 22, can increase storage of soap solution in storage rings 10D. Other textures helping increase storage on rings 10D are also possible.

Framework 10 can be made of any material sufficiently rigid to assume a substantially planar form during launch and flight, and allowing apertures 10A and rings 10D to hold and release solution as bubbles, as previously described. Flexible or foldable materials such as polypropylene, rubber, or even certain fabrics are not precluded, provided centrifugal force causes the material to flatten substantially to planar form during flight.

FIG. 2 is a section through apparatus 101, with planar open framework 10 being cast in the direction of the arrow Z, parallel to the plane of the apertures 10A.

Figure 3:
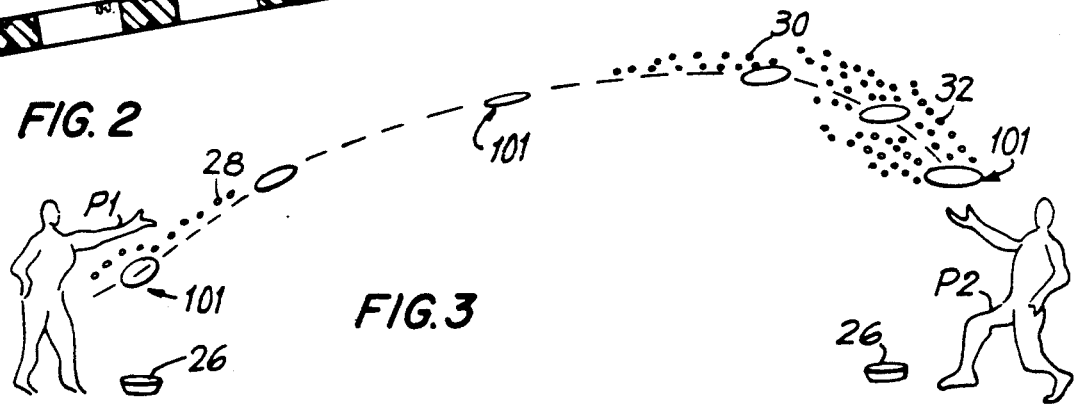
FIG. 3 shows two players using the toy, each player having a shallow pan of soap solution in which to dip the toy. The toy is shown releasing a small number of bubbles as it is launched, and an ample continuous stream of bubbles as it descends.

Player P1 in FIG. 3 dips the apertures of toy apparatus 101 in a flat pan of solution 26. Other container shapes such as a kitchen pot or a bucket will also work. As player P1 throws toy 101, a few bubbles 28 are produced at the beginning of the flight. Many more bubbles 30 are produced in midflight, and even more bubbles 32 are produced as the toy falls completing the flight. In two-person play, the toy is caught by player P2, who dips the apparatures in a second container of solution 26, and casts the toy on its return flight to player P1. Prototypes of this device have been thrown 50 feet or so, producing a trail of bubbles during most of the flight, with the majority streaming out in a beautiful falling arc at the end.

Figure 4:
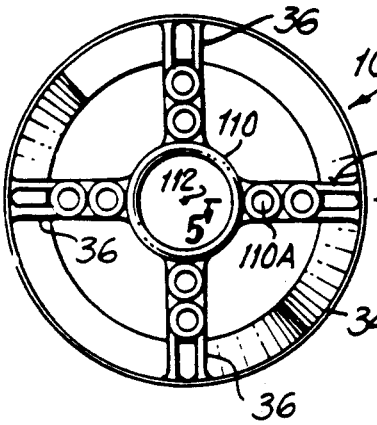
FIG. 4 is a second embodiment further including an annular aerodynamic surface for longer gliding flight.

The second form of toy apparatus 102 in FIG. 4 comprises a skeletal open framework 110. Framework 110 includes bubble-forming apertures 110A which may be textured similar to texture 22 in FIG. 1; an annular aerodynamic surface 34; and struts 36, four pairs being shown in FIG. 4, said struts offsetting aerodynamic surface 34 from the plane of framework 10. Apparatus 102 has an axis of rotation 112, about which it rotates during flight.

Figure 5:
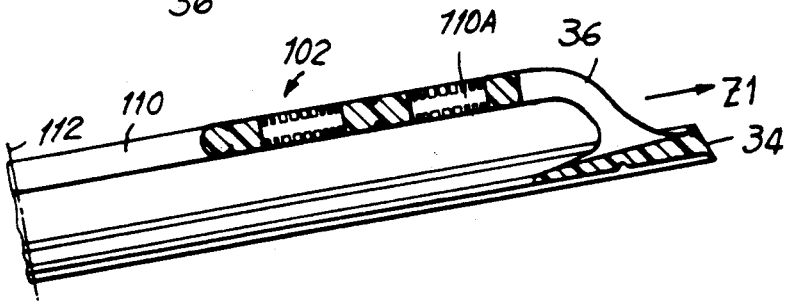
FIG. 5 is a section through the edge of the second embodiment, taken along the line 5—5 of FIG. 4.

As seen in FIG. 5, aerodynamic surface 34 typically has a section which creates lift. The profile shown is borrowed from Adler Patent No. 4,560,358, but other aerodynamic shapes like those disclosed in previously cited flying toy patents could also be used.

In FIG. 5 apparatus 102 is launched in the direction of arrow Z1. Planar open framework 110 and apertures 110A are offset by pairs of struts 36 from the plane of aerodynamic surface 34. Many other designs for offsetting struts 36 are obviously possible, this particular paired design being intended to combine strength with lightness in a molded plastic construction.

Figure 6:
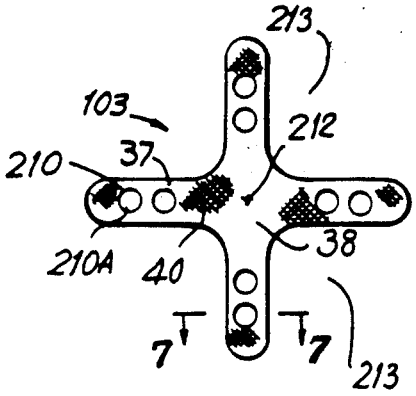
FIG. 6 shows a third form of the toy wherein the planar open framework comprises an arrangement of blades containing bubble apertures substantially bordered by open space.

In FIG. 6, toy apparatus 103 comprises a skeletal open framework 210 having bubble-forming apertures 210A set into several blades 37 in a radial configuration, said apertures 210A being substantially bordered by open space 213. There is an axis of rotation at 212. In this design, apertures 210A, while being initially dipped in solution, are also fed solution during flight from a solution storage surface 38. Texture 40 of storage surface 38 is shown here as a rough porous fabric able to absorb solution during dipping, and, aided by centrifugal force, direct said solution through capillary pores to apertures 210A.

Figure 7:
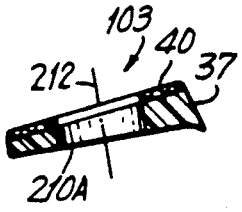
FIG. 7 shows a section through one of said blades, taken along the line 7—7 of FIG. 6.

In FIG. 7, textured fabric 40 is shown in section applied to a rigid aerodynamic blade 37, with aperture 210A piercing both. Alternatively, the construction could be all of a rigid material textured with grooves and ridges, a pattern of raised dots, or some other texture which is able to increase storage of solution and direct it towards the apertures.

Figure 8:
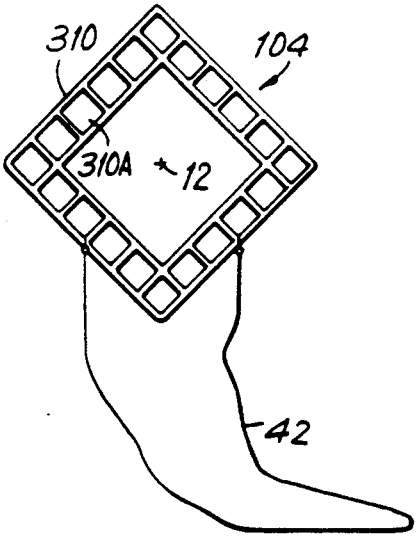
FIG. 8 shows a fourth form of the toy, in which the bubble-producing apertures are rectangular, and are arranged around the perimeter of the toy. Also shown is a tether which optionally may be attached to the toy, enabling the operator to whirl the toy around in tethered flight.

FIG. 8 shows toy apparatus 104 comprising a rectangular planar open framework 310 with apertures 310A arranged around the perimeter and bordered substantially by open space. This drawing serves merely to illustrate just one more of numerous configurations that a planar open framework might take. The perimeter might be round, square, cruciform, polygonal, oval, rectangular, elongated, star-shaped, or any other planar shape suitable for launching into flight. Apertures 310A could vary likewise in shape, and be arranged radially with respect to a center, or around a perimeter, or in clusters, or in any other arrangement suitable for producing bubbles from a planar open framework in flight. FIG. 8 also illustrates a tether 42, which optionally may be attached to any such apparatus.

Figure 9:
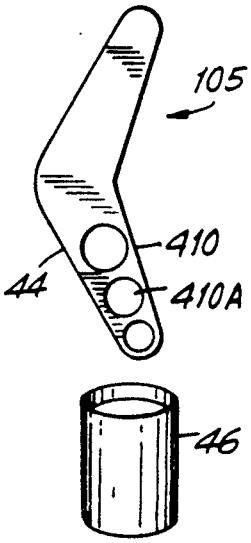
FIG. 9 shows yet another form of the toy in the shape of a boomerang, one blade of which is cut out to form bubble apertures substantially bordered by open space. The apertures can be dipped into a small container of solution.

FIG. 9 shows an apparatus 105 comprising an elongated aerodynamic surface 44 in the shape of a boomerang. Surface 44 includes a pair of blades 410, one of which has been pierced with apertures 410A, which are bordered substantially by open space. Apertures 410A can be dipped into a relatively small container 46 of solution. Apparatus 105 is an example of an asymmetrical shape of which there are numerous other possibilities.

OPERATION OF THE APPARATUS

The operator P1 in FIGS. 1-3 typically grasps toy apparatus 101 by one of the outer aperture rings 10D, whereon texture 22 provides a positive grip. The operator then dips framework 10 in a container 26 of soap solution. If toy apparatus 101 is of a somewhat flexible material, the operator may avoid wetting his finger tips by bending apparatus 101 temporarily out of its plane while pressing down against the bottom of container 26, so that the portion gripped remains above the solution surface and serves as a dry handle.

Once wetted with solution, apparatus 101 is raised up, during which a few large bubbles will often emerge from large spaces 14 and 16, exhausting the solution therein, while solution in apertures 10A is substantially retained. Then apparatus 101 is cast edgewise, substantially parallel to the plane of the apparatus. As seen in FIG. 3, the force of the launch and the imperfect planarity of the operator's swing often causes a short stream of bubbles 28 to emerge from apertures 10A in the first part of flight. Toy apparatus 101 then continues in rotating flight, maintaining the plane of apertures 10A substantially parallel to their planar orientation at the moment of launch. Perimeter frame element 10C is especially helpful in maintaining this original orientation, providing much of the rotational inertia required, and without which there is a tendency for flight to veer sharply, and even randomly tumble. While the toy is moving parallel to the plane of apertures 10A, air flows substantially across, i.e. above and below, rather than through said apertures, and except for the few bubbles formed during launching, most of the solution in apertures 10A and storage rings 10D is retained. Later in the flight, while the planar framework remains substantially parallel to its planar orientation at launching, the changing and downwardly falling trajectory causes air to begin passing through apertures 10A, initiating the release of bubbles 30.

Finally, as the trajectory falls more and more steeply, bubbles 32 are released in a dense continuous stream. Toy apparatus 101 is then caught by second player P2, who simply thrusts a finger or two through open framework 10. During the catching process, frame element 10C is especially easy to catch and also serves as a bumper, helping protect a player from being wet accidentally by solution, a little of which may still remain in apertures 10A.

In FIGS. 4 and 5, operation of toy apparatus 102 is similar. Struts 36, which offset open framework 110 from aerodynamic surface 34, enable the operator to hold surface 34 as a handle means and dip open framework 110 into solution without wetting surface 34 or the fingers. The toy can then be cast as previously described, with aerodynamic surface 34 extending the distance of flight.

The operation of apparatus 103 in FIG. 6 is again similar to the dipping and casting procedure of apparatus 101, except in this case apparatus 103 is grasped by the textured tip of a blade 37. In this case, substantial quantities of solution are stored in textured storage surface 38. Solution stored immediately adjacent to apertures 210A will be fed to said apertures by capillary action. During flight, centrifugal force will cause additional stored solution to migrate away from the central axis 212 and towards bubble-forming apertures 210A, thus replenishing solution being released from them as bubbles. In FIG. 7, the flight of apparatus 103 is extended by blades 37 having an aerodynamic cross-section as previously described.

Toy apparatus 104 in FIG. 8 is simply dipped and cast edge-wise as described for apparatus 101. In cases where apparatus 104 is of a flexible or foldable material, it may be folded down into a relatively small container of solution, springing back into planar shape upon being withdrawn from solution and launched. When optional tether 42 is attached to the apparatus 104, the toy can be dipped in solution, raised by tether 42, and whirled around the operator. Tether 42 can control such tethered flight so that it begins edgewise, and solution is temporarily retained in apertures 310A. Later in flight, tether 42 can control the angle of planar open framework 310 to the direction of flight, thus regulating the production of bubbles at any given moment.

The operator of toy 105 in FIG. 9 dips apertures 410A in container of solution 46, while holding the other blade of surface 44. He then casts toy 105 edgewise into flight, whereby the changing trajectory of flight first causes solution to be retained, and later to be released in a stream of bubbles, as previously described.

We have now disclosed several forms of a toy comprising a planar substantially open framework including bubble-forming apertures, and having an axis of rotation during flight. The apertures, when cast edgewise with said framework into flight, are able to retain substantial amounts of solution for release later in flight as the changing trajectory causes air to pass through the apertures. Several aerodynamic shapes suitable for extending or boomeranging the flight have been disclosed. Means for storing additional solution on board the toy apparatus and for feeding said solution centrifugally to the bubble apertures have been described. The tethering of a planar open framework and the controlled production of bubbles during tethered flight, has been described. Finally, we have shown a method for using a planar open framework including bubble apertures to produce bubbles during flight, said method comprising the steps of dipping the apertures in solution, casting said open framework edgewise into flight, and allowing the changing trajectory first to pass air over the apertures so that bubble solution is retained therein, and later in the flight to begin passing air through the apertures in order to produce a stream of bubbles.

I claim:

1. A bubble toy for producing a stream of bubbles when launched into free flight, said toy comprising: a substantially open framework including one or more apertures lying substantially in a plane, said apertures capable of being filled with bubble solution, said apertures further being capable of retaining substantial amounts of solution when said toy is launched parallel to said plane, and said apertures releasing said solution in a stream of bubbles when the changing trajectory of flight causes air to pass through said apertures, the framework having an axis of rotation during flight substantially normal to said plane.

2. The toy of claim 1, wherein the framework has a perimeter comprising a ring as an outer rim of the open framework.

3. The toy of claim 1, wherein the toy has rotational symmetry about said axis.

4. The toy of claim 2, wherein the ring is circular.

5. The toy of claim 1, further including an aerodynamic surface fixed to the framework.

6. The toy of claim 5, wherein the aerodynamic surface forms a ring bounding the framework.

7. The toy of claim 5, wherein the aerodynamic surface comprises blades arranged radially around a center.

8. The toy of claim 7, wherein there are four oppositely disposed blades.

9. The toy of claim 5, wherein the bubble-forming apertures are spaced along the aerodynamic surface.

10. The toy of claim 5, wherein the bubble-forming apertures are spaced from the aerodynamic surface.

11. The toy of claim 10, wherein the aerodynamic surface is offset from the bubble-forming apertures, enabling said apertures to be dipped into solution without wetting said aerodynamic surface.

12. The toy of claim 1, wherein the bubble-forming apertures are bordered by members which are textured to increase solution-holding capacity.

13. The toy of claim 12, wherein the members are grooved in a plurality of channels leading bubble solution towards the apertures.

14. The toy of claim 1, further comprising means for storing and feeding additional solution into the apertures during flight.

15. The toy of claim 14, further comprising a central portion, wherein the means for storing solution is a textured surface area in the central portion wherein said textured area is able to retain substantial amounts of solution when the frame work is dipped, and is further able to feed said solution by centrifugal force to bubble-forming apertures when said apparatus is launched into rotating flight.

16. The toy of claim 15, wherein the textured area in the central portion comprises a fabric.

17. The toy of claim 1, wherein the toy is shaped like a boomerang.

18. The toy of claim 1, wherein said toy is made at least partially of a flexible resilient material, whereby the framework can be bent temporarily out of its plane when pressed against a shallow solution container, and can resume its substantially planar form while being removed therefrom.

19. The toy of claim 1, further comprising a handle member fixed to the framework.

20. The toy of claim 1, wherein said framework includes large openings for enabling easy catching of the apparatus by thrusting one or more fingers through the apparatus.

21. The toy of claim 1, wherein said apertures are substantially bordered by other apertures or by large open spaces.

22. The toy of claim 1, wherein the framework has a perimeter member whereby during flight said perimeter forms a leading edge carrying a minimum of soap solution and which also acts as a bumper protecting the catcher from bubble-forming apertures still partially filled with solution.

23. The toy of claim 1, wherein at least a portion of the framework may be folded so that the apparatus can be dipped in a relatively small container.

24. The toy of claim 5, wherein the aerodynamic surface causes the framework to boomerang in flight back towards the operator.

25. The toy of claim 1, wherein a tether is attached to the framework for constraining said free flight.

26. The toy of claim 25, wherein the tether enables the operator to substantially control the angle of the plane of the framework to the direction of motion, thereby controlling the flow of air through the apertures and the production of bubbles during tethered flight.

27. A method for producing a stream of bubbles from a flying bubble toy comprising a substantially open framework including one or more bubble-forming apertures lying substantially in a plane, said method including the steps of:

(i) dipping said apertures in bubble solution, (ii) launching said toy into the air in a direction substantially parallel to said plane, whereby air passes substantially across said apertures, and solution contained in said apertures is temporarily and substantially retained, and (iii) allowing flight trajectory to change so that air passes through the apertures, thereby releasing a stream of bubbles as the toy descends.

28. The method of claim 27, wherein the dipping step further comprises bending a portion of the framework to form a temporary handle.

29. The method of claim 27, further including catching the toy by thrusting one or more fingers through the open framework.

30. The method of claim 27, further including at least partially folding the apparatus before dipping it in a container of solution.

31. The method of claim 27, further including attaching a tether to the bubble toy.

32. The method of claim 31 further including the step of using the tether to control the angle of said plane to the direction of flight, thereby controlling the flow of air through the apertures and the production of bubbles.

33. A method of two player play with a flying bubble toy comprising an open framework including one or more bubble-forming apertures lying substantially in a plane, said method including the steps of:

(i) dipping said apertures in bubble solution by a first player, (ii) launching said toy into the air by said first player in a direction substantially parallel to said plane, whereby air passes substantially across said apertures and solution contained in said apertures in temporarily and substantially retained, (iii) allowing flight trajectory to change so that air passes through the apertures, thereby releasing a stream of bubbles as the toy descends, and (iv) catching the toy by a second player, repeating the above steps, and re-launching said toy to the first player.

34. A method for producing a stream of bubbles from a flying bubble toy comprising one or more bubble forming apertures lying substantially in a plane, said method including the steps of:

(i) dipping said apertures of said toy into bubble solution, (ii) launching said toy into the air in a direction substantially across said apertures, and solution contained in said apertures is temporarily and substantially retained, and (iii) allowing flight trajectory to change so that air passes through the apertures, thereby releasing a stream of bubbles as the toy descends.

35. The toy of claim 1, wherein because of rotational inertia of the toy during flight the plane of apertures remains substantially parallel to their planar orientation at the moment of launching, preventing the toy from veering sharply or tumbling.

36. The toy of claim 1, wherein the frame work is skeletal.

37. A bubble toy for producing a stream of bubbles when launched into free flight, said toy comprising:

a substantially open skeletal frame work including one or more apertures lying substantially in a plane, said apertures capable of being filled with a bubble solution, said apertures further being capable of retaining substantial amounts of solution when said toy is launched parallel to said plane, and said apertures releasing said solution in a stream of bubbles when the changing trajectory of flight causes air to pass through said apertures, the open skeletal framework having an axis of rotation during flight substantially normal to said plane.

* * * * *